US006223704B1

(12) United States Patent
Chatelain

(10) Patent No.: US 6,223,704 B1
(45) Date of Patent: May 1, 2001

(54) SPARK-IGNITION ENGINE, FLAT AND WITH OPPOSITE CYLINDERS

(76) Inventor: Michel Chatelain, 10 rue du Ramponnet, F-74940 Annecy le Vieux (FR)

( * ) Notice: Subject to any disclaimer, the term of this patent is extended or adjusted under 35 U.S.C. 154(b) by 0 days.

(21) Appl. No.: 09/299,011

(22) Filed: Apr. 26, 1999

(30) Foreign Application Priority Data

Apr. 24, 1998 (FR) ..... 98 05142

(51) Int. Cl.[7] ..... F02B 75/24; F02B 75/32
(52) U.S. Cl. ..... 123/55.2; 123/197.4; 123/197.3
(58) Field of Search ..... 123/55.2, 55.4, 123/55.5, 55.6, 55.7, 193.4, 193.6, 197.2, 197.4, 197.3

(56) References Cited

U.S. PATENT DOCUMENTS

| | | | | |
|---|---|---|---|---|
| 2,009,493 | * | 7/1935 | Guilford et al. | 123/55.5 |
| 2,852,837 | * | 9/1958 | Fageol | 123/55.4 |
| 4,026,252 | * | 5/1977 | Wrin | 123/54.2 |
| 4,485,768 | * | 12/1984 | Heniges | 123/48 B |
| 4,981,120 | * | 1/1991 | Mangum, Jr. | 123/55.5 |
| 5,158,046 | * | 10/1992 | Rucker | 123/65 R |
| 5,233,949 | * | 8/1993 | Rucker | 123/71 R |
| 5,331,926 | * | 7/1994 | Vaux et al. | 123/55.3 |
| 5,402,755 | * | 4/1995 | Waissi | 123/55.3 |
| 5,676,104 | * | 10/1997 | Chatelain | 123/193.6 |
| 5,778,834 | * | 7/1998 | Piccinini | 123/55.2 |
| 5,778,835 | * | 7/1998 | Vought | 123/55.5 |
| 5,862,781 | * | 1/1999 | Rossle | 123/55.7 |
| 5,873,339 | * | 2/1999 | Isogai | 123/197.4 |
| 5,894,821 | * | 4/1999 | Chatelain | 123/65 V |
| 5,950,579 | * | 9/1999 | Ott | 123/54.4 |
| 6,073,595 | * | 6/2000 | Brogdon | 123/55.5 |
| 6,082,314 | * | 7/2000 | Li et al. | 123/55.4 |
| 6,142,129 | * | 11/2000 | Hori et al. | 123/572 |

* cited by examiner

*Primary Examiner*—Willis R. Wolfe
*Assistant Examiner*—Hai Huynh
(74) *Attorney, Agent, or Firm*—William A. Drucker

(57) ABSTRACT

The engine includes at least two cylinders 2 laid out flat and opposed one to the other, a crankshaft 9 to transmit to the output shaft of the engine the energy provided by the explosions in cylinders 2. A rigid connecting rod assembly 18 connects crankshaft 9 to the pistons 17 mobiles in cylinders 2. Connecting rod assembly 18 is assembled directly on the crankshaft 9 which is cast solid, without sliding shoe. The bottom of each cylinder 2 ends in a trunked cone whose top determines, with an end of piston 17, an exhaust port which is closed before the lights of transfer, by starting a strong depression and a overfeeding of the engine.

16 Claims, 6 Drawing Sheets

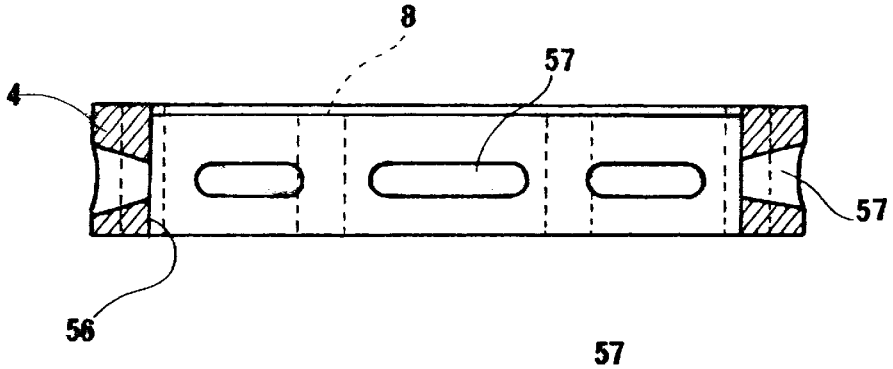
FIG.5
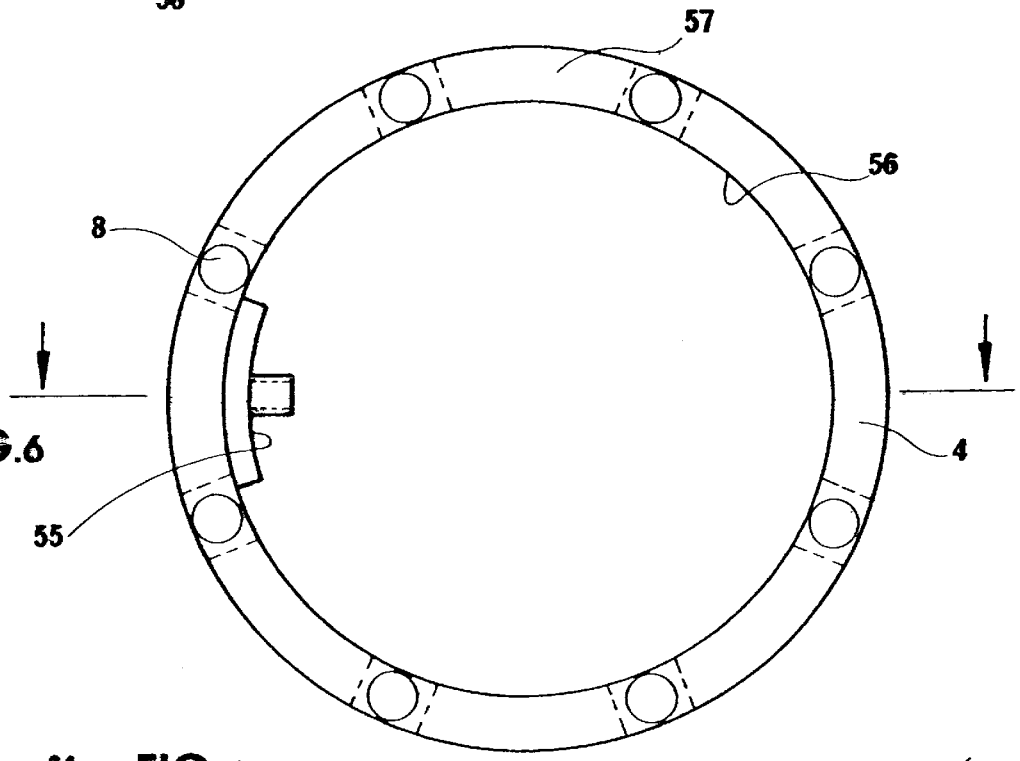
FIG.6
FIG.7
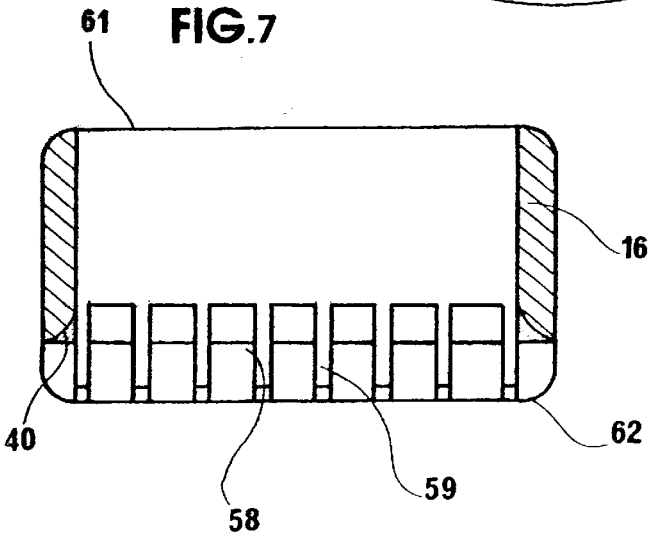
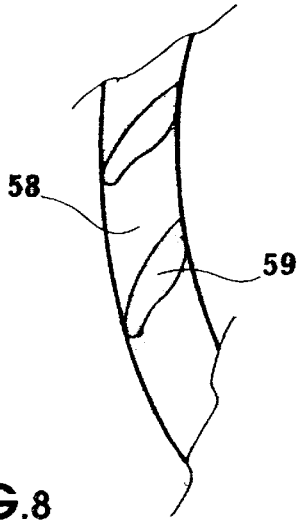
FIG.8

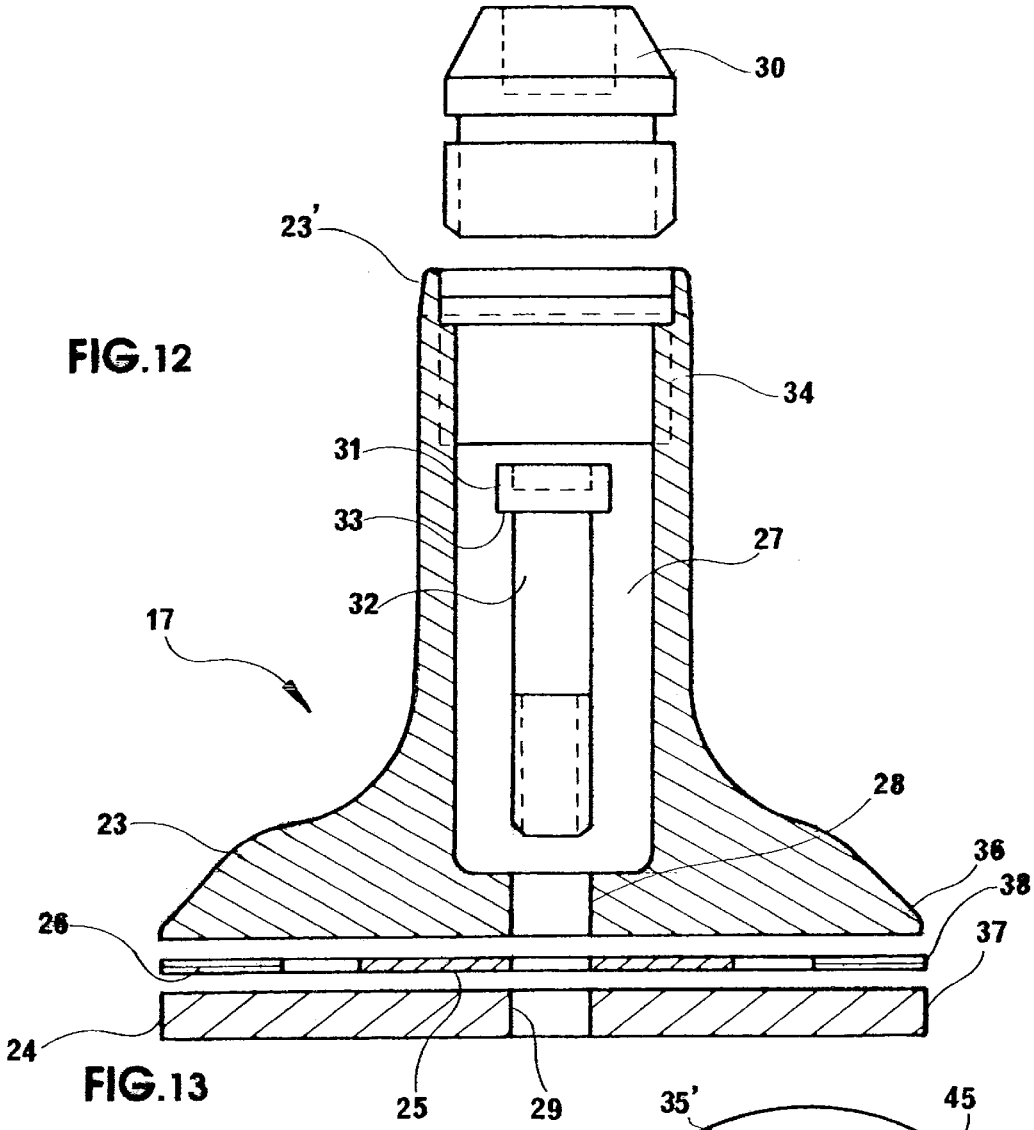
FIG.12
FIG.13
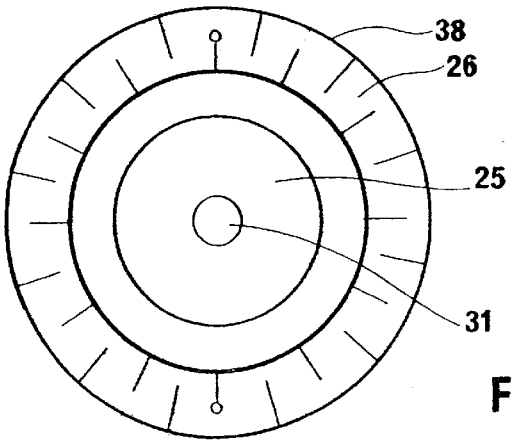
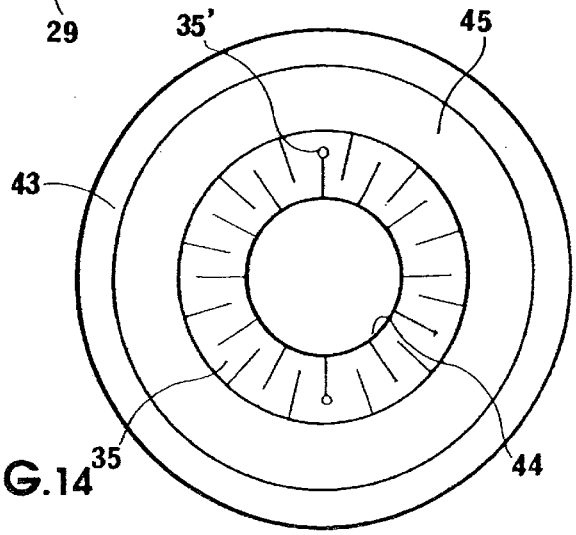
FIG.14

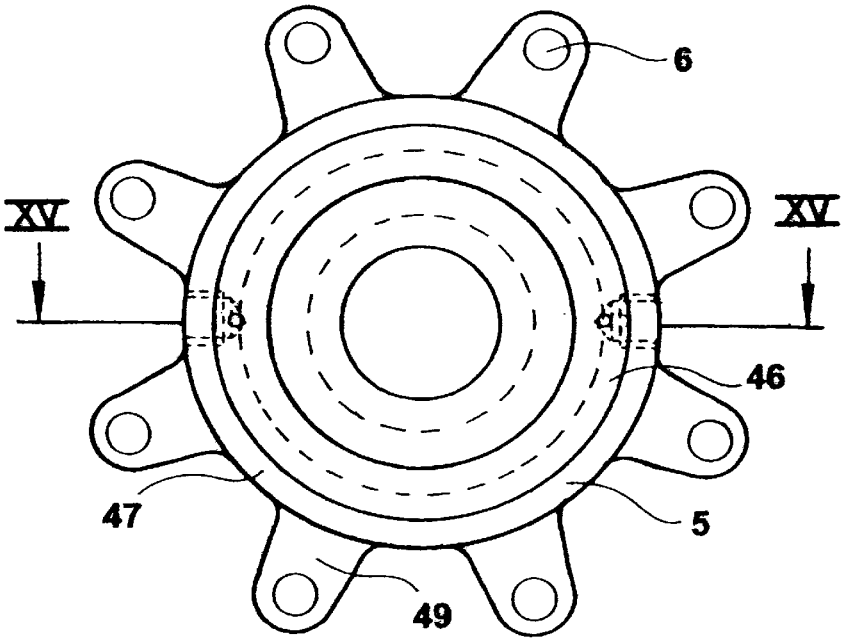
FIG.16
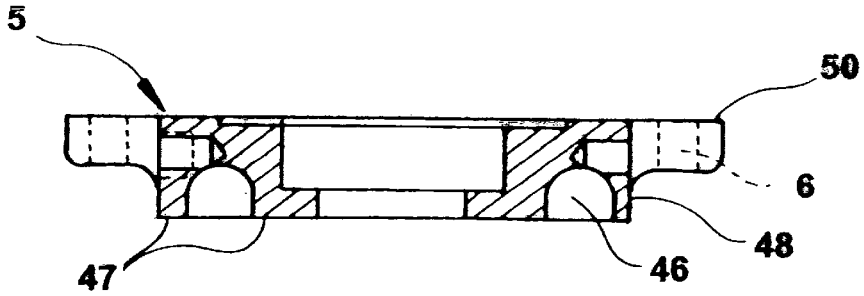
FIG.15
FIG.17
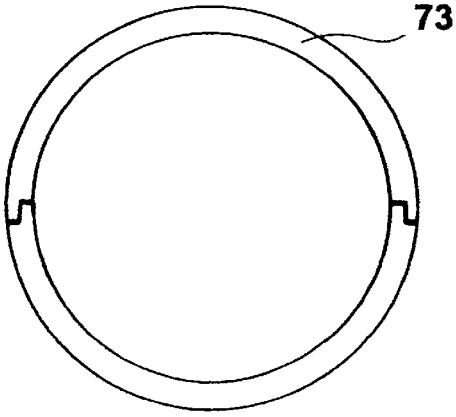
FIG.18
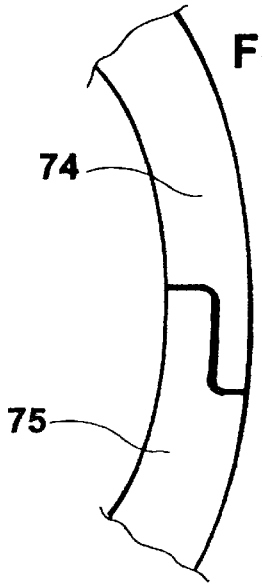

SPARK-IGNITION ENGINE, FLAT AND WITH OPPOSITE CYLINDERS

FIELD OF THE INVENTION

The present invention relates to an spark-ignition engine of the type flat and with opposite cylinders.

BACKGROUND OF THE INVENTION

One flat knows engines and with opposed cylinders, which are equipped with an reticulated connecting rod assembly placed in a casing in two parts whose mating plane is located in the axis of the crankshaft and perpendicular to the plan which passes by the axis of the cylinders.

With this known design of the engines flat and with opposed cylinders, the pressures of explosion are transmitted, through the crankshaft, directly with the screw fasteners of the two half-casings. So very quickly, the casing becomes deformed and flees.

Moreover, with the known engine mentioned above, the crankshaft is heavier because it must comprise masses of balancing much more important. The engine itself is heavy, bulky, and with much of parts moving.

SUMMARY OF THE INVENTION

The present invention has as an aim to cure the disadvantages mentioned above presented by the engines known flat and opposite cylinders mentioned above, and it proposes for this purpose to produce an spark-ignition engine, flat and with opposed cylinders, which constitutes a more compact unit, more rigid and with a maximum of standard and modular parts. It aims at constructing a lighter, more reliable unit and of a less cost price, comprising less parts moving, and showing of a reduced rate of consumption and of pollution.

The spark-ignition engine according to the invention is of the type including at least two cylinders laid out flat and opposed one to the other, a crankshaft ensuring the drive the shaft of exit of the engine of the energy provided by the explosions in the known as cylinders, and a connecting rod assembly connecting the crankshaft to the mobile pistons in the known as cylinders. It is characterized in that the known as connecting rod assembly is rigid and is assembled directly on a cast solid crankshaft, without sliding shoe.

Indeed, by replacing the conventional connecting rod assembly articulated by a rigid connecting rod assembly, the system balances itself and the inertias are withdrawn instead of being cancelled to no purpose, by ensuring a profit of power of approximately 30%. The masses of balancing of the crankshaft are used only for balancing of the crank pins, and, so they are much lighter than with an articulated connecting rod assembly for which it is necessary to take account of the mass of the rod and the piston.

With a rigid connecting rod assembly according to the present invention, the pistons which are perfectly guided do not touch the cylinders, only the ring seals ensure the contact and the sealing with a very weak surface of friction.

According to an additional characteristic of the invention, the spark-ignition engine includes two identical half-casings whose mating plane passes by the axis of the cylinders, the rigid connecting rod assemblies, the flanged guides of the rigid connecting rod assemblies, the pistons and the cylinder heads of the engine. With this provision, the assembly is facilitated and, once the assembled casing, it occurs only very few efforts on the bolts assembling the two half-casings. The casing thus obtained has same rigidity as a cast solid casing.

According to another characteristic of the invention, the half-casings are positioned one compared to the other by the components of the engine, this positioning being ensured in a plan by sealing rings and bearings of guidance of the crankshaft and, in a perpendicular plan, by the flanged guides of the rigid connecting rod assembly. One thus obtains a perfect positioning of the half-casings one compared to the other, without use of the centerpiece necessary with a conventional casing and which bring often only one defective precision.

According to still another characteristic of the invention, the bottom of each cylinder ends in a truncated cone whose top determines an annular light of exhaust with the end of the piston emerging inside the cylinder. This passage of exhaust entirely free, and with a precise adjustment of the exhaust fumes passage by the length of the small diameter of the piston, constitutes a particularly advantageous solution This solution is made possible, according to a complementary characteristic of the invention, by the fact that the piston presents contrary to the connecting rod assembly a part of small diameter on which the sealing is held by the interior diameter of a ring placed between the cylinder and the cylinder head of the engine, the end of the piston emerging from the known as ring at each point died low, by then allowing the passage of exhaust fumes by the interior diameter of the known as ring.

The lubrication of the ring and the cooling of the cylinder are ensured by an oil circulation in an annular throat laid out between the ring and a shim external to the ring. The gauged exhaust of the oil of the annular throat regulates the oil pressure of the engine.

So that the exhaust fumes are evacuated easily, the cylinder presents a conical end which ensures their guidance and their concentration.

The conical part of the cylinder allows a dynamic overfeeding of the engine. Indeed, during closing to the exhaust of the cone of pressure determined by the cone at the head of the cylinder and the small diameter of the piston, the speed of exhaust of gases is close from the speed of the sound and, with speed, these gases are crushed in the cone and are very strongly densifient from the top of the cone where the pressure is strongest (about 100 bars) to reach a null pressure at the place of the largeest diameter of the cone, the remainder of the cylinder being with a negative pressure whose absolute value increases while approaching the lights of transfer.

Because of the important depression on the level of the lights of transfer, the induction valves open instantaneously under the effect of the difference in pressure between the atmospheric pressure outside the cylinder and the vacuum inside the cylinder, by starting a complementary filling of air. When the induction valves are closed during the closing of the lights of transfer, gas pressure which was standardized a little inside the cylinder reached 4 bars or more before compression does start. This value of 4 bars is however only indicative, and it varies according to the pressure losses, of the dimensions given to the exhaust ports, of transfer, and admission, and speed of revolutions of the engine.

The point angle of the conical part of the cylinder also has a great influence on the value of the dynamic pressure, the aforementioned increasing when this angle increases up to a value of approximately 60°. Thus, more dynamic pressure will be sought, and more one will decrease the point angle of the conical part of the cylinder, until a limit imposed by the pressure loss on the exhaust which becomes too important and/or by a too great height of the unfavourable cone on a good general design of the head of the cylinder.

The dynamic pressure thus generated is so important that the volumetric filling, carried out by the lower part of the pistons in ascending phase, has little importance and can even be lower than 1 without influencing in a sensitive way the dynamic pressure of overfeeding obtained at the moment of the closing of the lights of transfer, right before the phase of compression. It is thus possible to use stems of connecting rod assembly of diameter higher than the small diameter of the pistons, which finds mainly its application on the small engines and the micro engines.

According to another characteristic of the invention, the pistons can be out of steel, aluminium or another metal, and the part of small diameter of each piston is hollow, is filled by a coolant and is closed by a tight stopper. One obtains thus that the combustion chamber remains hot, with a uniform temperature on the height of the piston. According to another realization, the pistons can be out of aluminium with, on the surface, an insulating ceramic layer of great hardness, which is self-lubricating hot like cold. The temperature is then standardized by conduction on all the matter of the piston, which presents the thickest possible walls for a good conduction of the calories of the end of the small diameter of the piston until worms the ring and the shim of the large diameter of the aforementioned.

The end of the part of small diameter of the piston is then free, and not plugged up anymore, and it presents only one hole for the passage of the head of screw. The end of the external diameter of the piston ends in a light round cone and is polished to facilitate the introduction of the piston into the ring of exhaust.

According to another characteristic of the invention, it is the latch-tightening screw of the three parts of the piston on the rigid connecting rod assembly which is used to center the parts compared to the axis of the stems of the rigid connecting rod assembly so that the pistons are centered perfectly on the stems of the rigid connecting rod assembly.

According to another characteristic of this invention, the components of the engine are manufactured separately, which facilitates manufacture and makes it possible to use materials and surface treatments adapted to each function. These components which pile up, are centered and blocked between them include the stage of connecting rod assembly, the eduction valve box, the sleeve, the cylinder, the ring with its shim and the cylinder head, and they are sandwiched between the cylinder head and the casing.

According to another characteristic of the invention, the crankshaft internally comprises conduits of lubrication of large diameter going from the outside of a crank pin of the crankshaft thru the middle of a stage of the crankshaft, two known as conduits coming from two crank pins of the crankshaft thus which can be connected inside a crankshaft bearing while being fed by a single oil arrival under pressure. Of this way, all the crank pins and the stages of the crankshaft can be reduced, even in the case of a crankshaft with four crank pins. Each crank pin has jets for the passage of oil on the plane faces of an attachment, or a hole of lubrication.

According to still another characteristic of the invention the rigid connecting rod assemblies present, for their assembly on the crank pins of the cast solid crankshaft, lights open on a side, a removable hat ensuring the closing of each known as light once the connecting rod assembly placed on the crank pin.

The crankshaft, like the rigid connecting rod assembly, is soaked and receives a surface treatment very hard and self-lubricating. Aquaplaning as well as the presence of hard surfaces self-lubricating make it possible to ensure a long operation life.

According to another characteristic of the invention, the connection of the crank pin with the light of the connecting rod assembly can be carried out in various ways which include:

- the use of a split ring assembled on the crank pin and which plays the part of roller,
- a direct contact of the crank pin on the connecting rod assembly thanks to a very hard and self-lubricating surface treatment, deposited on soaked surfaces, which combines with aquaplaning.

According to still another characteristic of the invention, the stages of connecting rod assembly are assembled without sealing so that the running clearance of these stages makes it possible for the gas under pressure below the pistons to pass towards the interior of the casing while putting says it casing under pressure of air and by driving out oil being in the casing by a drain equipped with a non-return valve.

One can thus function <<dry casing>> without having to use of cam in the casing. The oil thus driven out of the casing is collected in a tank from where it is then pumped to put in pressure the circuit of lubrication.

Advantageously, the oil cam ensuring the pressurization of the circuit of lubrication is incorporated in the injection cam. This provision allows a simpler design of the engine, the cam oil being accessible from outside what facilitates any intervention relating to it.

According to still another characteristic of the invention, the injection cam is coupled directly in end of crankshaft, and this last is prolonged by the injection cam shaft which can be equipped with a pulley to actuate an alternator or a cam.

According to another characteristic still of the invention, to facilitate cooling without losing reliability, the cylinder head is out of high-strength hammered steel, whereas the other components of the engine contained by the cylinder head are out of aluminium. It is the cylinder head which heats more, but the grade of the steel used allows that it does not become deformed. The cooling of the cylinder head is mixed: a cooling by oil with a circulation around the ring, and an air cooling whose flow sweeps the cylinder. This cooling can also be water/oil, or even oil/oil in order to have one radiator of cooling.

The cylinder head is fixed in a multitude of points so that the pressure is regularly held on all its periphery. This cylinder head, made out of steel, shim compressed the aluminium components of the engine and prevents that they become deformed.

It is understood that the engine according to the invention, incorporating the characteristics above mentioned, has the advantages of a strong profit of weight, of a profit of appreciable volume, a low cost, low fuel consumption, a weak heating, a weak pollution and a great reliability.

BRIEF DESCRIPTION OF THE DRAWINGS

For rendering comprehensible well the invention one will describe some hereafter, as an example without restrictive character, a form of execution preferred in reference to the annexed diagrammatic drawing in which:

FIGS. 5 and 6 are, also at greater scale, a sight in section and a sight in plan, respectively, eduction valve box;

FIG. 7 is a sight in section, on a large scale, of a sleeve of a cylinder of the engine;

FIG. 8 is a sight of detail in end of the paddles present on the sleeve of FIG. 7;

FIG. 12 is, on a large scale, a sight burst out in cut of a piston of the engine of FIG. 1;

FIG. 13 is a sight in plan of the ring seal assembled on the large diameter of the piston and its internal shim associated;

FIG. 14 is a sight in plan of the ring of exhaust and its associated external shim;

FIGS. 15 and 16 are respectively a sight in section and a sight in plan of a cylinder head associated to a cylinder of the engine;

FIG. 17 shows a roller intended to be interposed between the rigid connecting rod assembly and the crank pin of the crankshaft;

FIG. 18 is a detail sight of FIG. 17, showing cuttings of the roller facilitating the closing of the aforementioned by joining, on the crank pin.

DETAILED DESCRIPTION OF THE PREFERRED EMBODIMENTS

Figure 1:
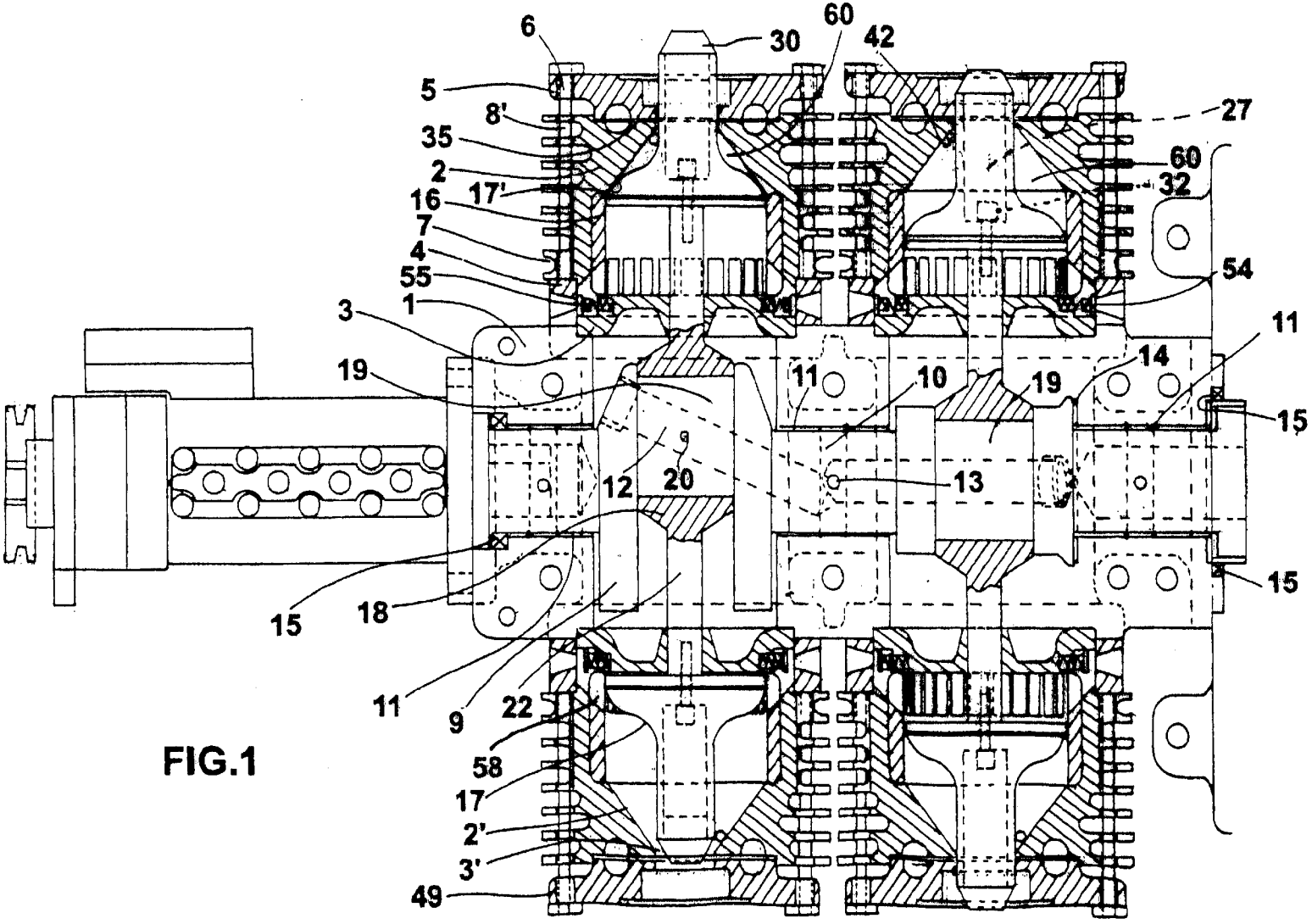
FIG. 1 is a horizontal cut of an engine flat and with cylinders opposed according to the invention, this cut being taken by the mating plane of the two half-casings of the engine.

In reference on FIG. 1, one represented into 1 a half-casing of an engine including four cylinders flat, opposed two to two. Each cylinder 2 is in support on a side on half-casing 1 by means of a stage of connecting rod assembly 3 and an eduction valve box 4 and other side against a cylinder head 5. Openings in glance 6 spared on the periphery of the cylinder head 5, 7 spared in the cylinder 2, 8 spared in the eduction valve box 4 allow the passage of pins or screw 8' to block the unit formed by elements 5, 2, 4 and 3.

Crankshaft 9 passes in a central stage 10 and is guided by bearing liners 11. Crankshaft 9 is bored by drains of large diameter 12 which are used to reduce the crankshaft and which meet in the medium of the central stage 10 from where arrives of the lubricant under pressure by a hole 13 which corresponds with a throat formed between bearings 11. Thrusts 14 make it possible to position crankshaft 9 and to support the pushes, whereas the sealing of the stages is ensured by sealing rings 15 which center half-casings 1 with bearings 11 around crankshaft 9 in a plan.

Each cylinder 2 internally wears a sleeve 16 with which a piston 17 cooperates, and two opposite pistons 17 are connected together by a rigid connecting rod assembly 18 of which the central part is in direct contact with a crank pin 19 of crankshaft 9. Jets 20 of crank pins 19 sprinkle with lubricant the plane faces of connecting rod assembly 18 which are in contact with crank pins 19.

Surfaces in friction of crankshaft 9 and connecting rod assemblies 18 are hardened thermically and covered with a surface treatment very hard and self-lubricating. This treatment constitutes a guarantee of reliability because it makes it possible to work dry with starting, or in the event of lack of oil.

Connecting rod assemblies 18 are positioned in casing 1 and on crankshaft 9 by the stages of connecting rod assembly 3 whose central residences 21 guide perfectly these connecting rod assemblies 18 in two opposite points on both sides of casing 1. The play between the stages and the stems 22 of connecting rod assemblies 18 is very weak, about 0,02 to 0,04 mm. Guidance is also done with the side faces of the rigid connecting rod assemblies 18 in support against the con-rod axle crank face 19.

Two opposite pistons 17 are perfectly centered with the stems 22 of the connecting rod assemblies 18, by screws 32, so that these two pistons 17 assembled on a connecting rod 18 form nothing else that one rigid and perfectly centered part.

As one sees it on FIG. 1, the cylinder head 2 ends in a truncated cone 2' whose top determines, with the end of emerging piston 17 coming from this cylinder, an exhaust light 3' which is closed before the lights of transfer 58. With the closing of the exhaust port 3', the gases which move at very high speed crush and densify very strongly in the top of cone 2 ' of the cylinder by producing a strong depression on the level of the lights of transfer 58 which are still open. This depression starts a second air inlet in the same driving cycle by producing an important overfeeding which lasts until the closing of the lights of transfer 57.

Piston 17 present on its large diameter a cone 17' identical to the cone 2' of the cylinder 2 and which is prolonged, towards the small diameter of the piston, by a machining which determines an annular combustion chamber 60 when piston 17 arrives at the point died high.

This annulus 60, variable and appreciably triangular section, allows a variable thickening of the air-fuel mixture. For an operation in weak mixture, a sufficient thickening with a good lighting always occurs in the high part of the combustion chamber 60 on the level of injector 42, which makes it possible to light all the mixture remaining, even if the aforementioned is very low in carburizing.

As one more particularly sees it on FIG. 12, piston 17 is made of two parts 23, 24 which take in sandwich an internal shim 25 and one ring seal 26. The part 23 of the piston presents an interior room 27 cylindrical continuing at an end by a cylindrical boring 28 coming in glance from a central cylindrical housing 29 from the part 24 of the piston. At its other end, room 27 is closed by a stopper 30.

Figure 10:
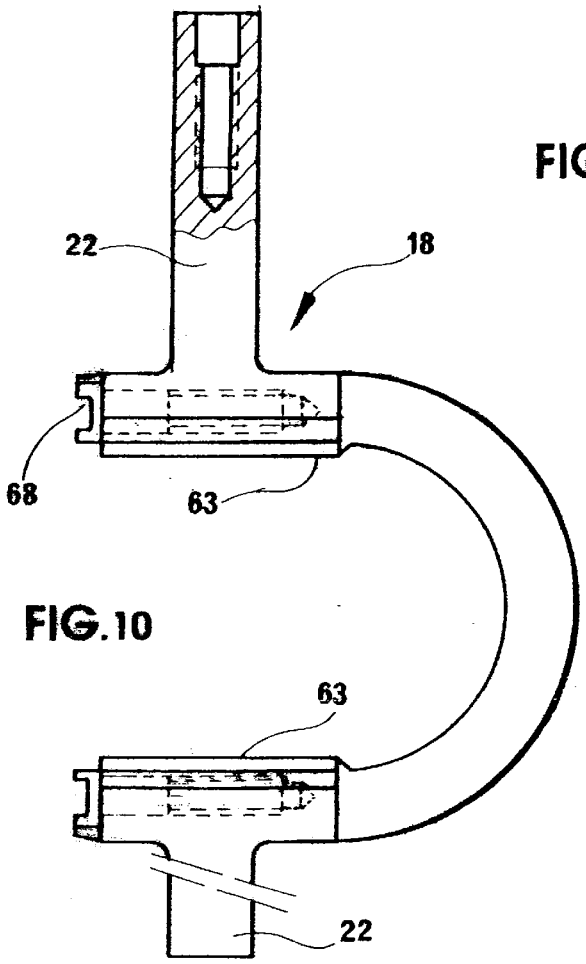
FIG. 10 is a side sight corresponding on FIG. 9.
Figure 9:
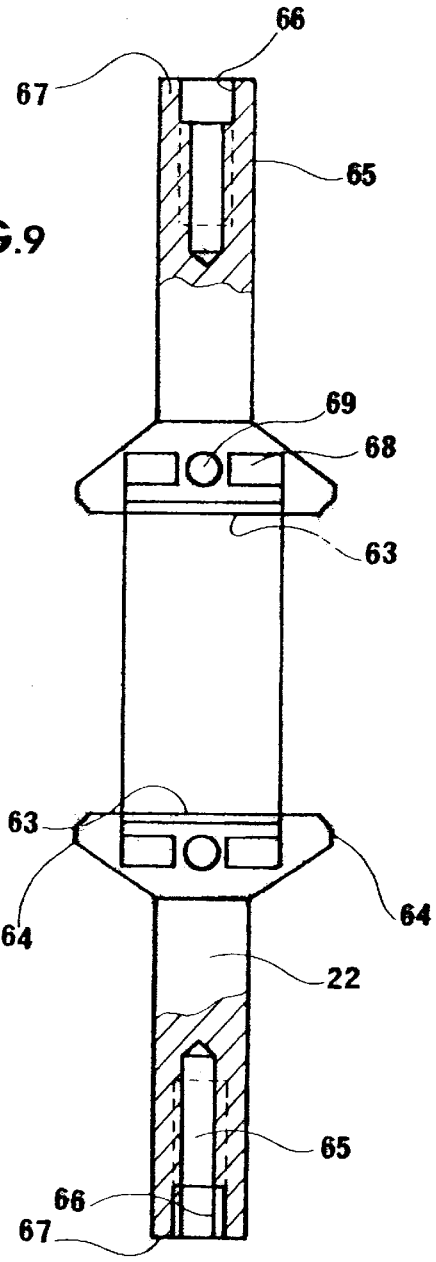
FIG. 9 is a sight of top, partially in section, of a rigid connecting rod assembly of the engine of FIG. 1, this connecting rod assembly being represented open.

At the interior of room 27 a screw 31 is presenting a rectified cylindrical part 32 which centers two parts 23,24 of piston 17 and fixes it 25 of ring 26 with the stems 22 of connecting rod assembly 18 (see FIGS. 9 and 10). The interior face 33 of screw 31 is also rectified to ensure the sealing between this screw and the part 23 of the piston. As one will further see it, room 27 is intended to contain a coolant, and stopper 30 ensures the tight closing of this room.

The small diameter external 34 of the part 23 of piston 17 is perfectly concentric with boring 28 and, on this diameter 34, only rubs a ring of exhaust 35 which will be described further.

Large diameters 36,37 of parts 23,24 of piston 17 are assembled with much play so that they do not touch sleeve 16. Only ring 26 is in contact with sleeve 16 of cylinder 2, which is made possible thanks to the guidance and the perfect centering of the parts between them.

With FIG. 13, one sees ring 26 ensuring the sealing by his external diameter 38 between piston 17 and 16 line it. The shim 25, which is centered by screw 31, rule the play of ring 26 in height, by allowing an assembly floating of this ring in the throat determined between the parts 23 and 24 of piston 17.

Thus the ring 26, which is mobile with piston 17, ensures him only a perfect sealing and of long duration with sleeve 16.

Figure 19:
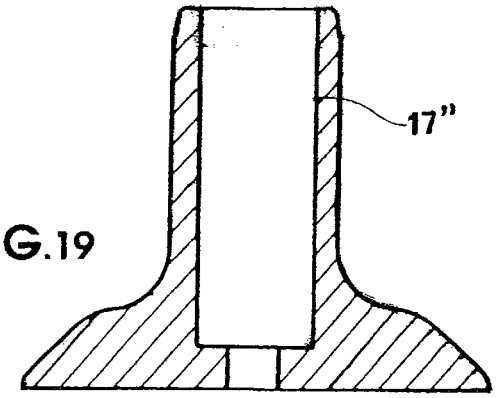
FIG. 19 shows an alternative of a piston.

According to an alternative represented on FIG. 19, piston 17' is made out of aluminium covered on the surface of an insulating ceramic layer of great hardness (2400HV). The interior of the piston, which does not contain any more fluid, is open with a nose bullet radiated on the small diameter to facilitate the penetration of ring 35 assembled with tightening on the interior diameter 44.

Figure 2:
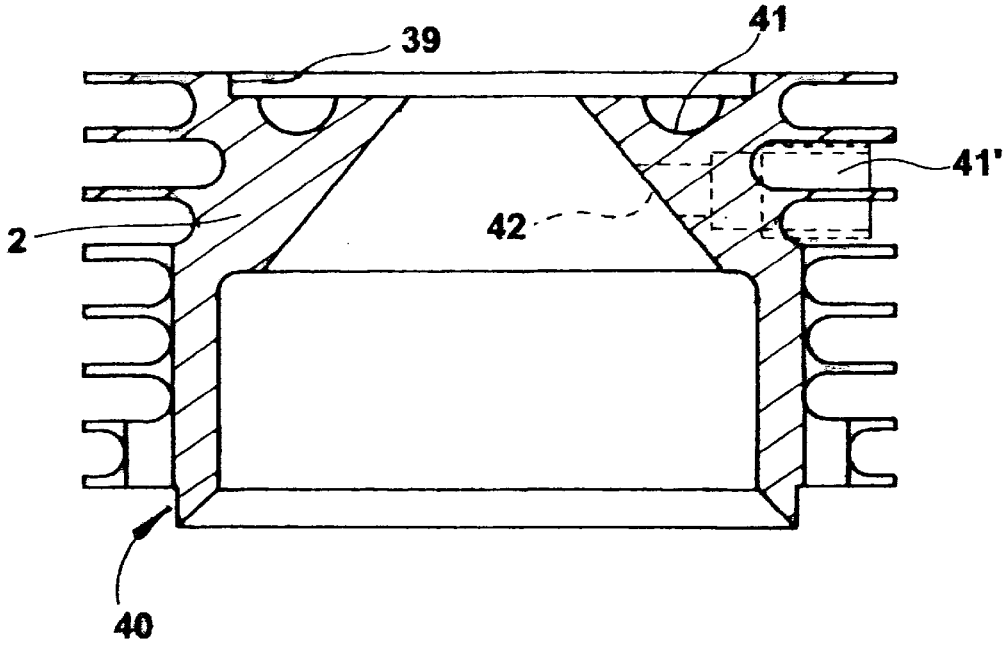
FIG. 2 is, on a large scale a sight in section of a cylinder of the engine.

In reference on FIG. 2, one represented cylinder 2, presenting at an end a centering 39 for cylinder head 5 and, at his other end a centering 40 in the eduction valve box 4. The bottom of centering 39 includes an annular throat 41 with semicircular section in which the oil of lubrication and cooling circulates.

In cylinder 2, one represented into 41' the housing of a fuel injector communicating by an opening 42 with the higher part of the interior volume of cylinder 2. The axis of the injector is tangent with the small diameter of piston 17, the injection being done in the direction of rotation of gases. The injector is located in top of room 60, in order to carry out an injection in two times so necessary with a larger density of fuel in the top of the conical part of the cylinder.

In the part of centering 39 of cylinder 2 are laid out, as represented on the FIG. 14, the ring seal 35 and fixes it 43 laid out concentrically outside this ring. Ring 35 fact the sealing, by its interior diameter 44 on small diameter 34 of the piston 17. This ring 35 is static and it is centered by diameter 34 of piston 17. The shim 43, which regulates the play in height of ring 35 is centered by cylinder 2.

Between shim 43 and ring 35 is formed an annular throat 45 which corresponds with throat 41 in cylinder 2 and with a throat 46 in cylinder head 5 (see FIG. 15) to form an annular throat of strong section and having an important heat-transferring surface. In this throat circulates the oil of lubrication of ring 35 and cooling of the top of cylinder 2 and cylinder head 5. This oil escapes then towards a cooler (not represented) which is also used as oil tank. The exhaust of oil is regulated by a throttling which defines the oil pressure with which the engine functions.

The ring of exhaust 35 is made of two superimposed discs crossed into 35', for their positioning, by two small pins a length higher than the thickness of the discs and which are placed in two holes spared in the cylinder. This provision is essential for the engines of four cylinders or more, in which a ring seal is always released with the stop, by preventing this ring slipping and from making a thrust with the piston during starting. The end of small diameter of piston 17 presents towards the outside a round-off 23' making the nose bullet of piston 17 in the ring of exhaust 35, facilitating the introduction of the piston into this ring. A weak play is always envisaged on the pins to keep the floating rings.

Attachments 18 guide perfectly the pistons which are assembled with an important play compared to the sleeve and with the cylinder correspondents, so that there is no friction piston/sleeve. Only rings 35 and 26 are in contact to ensure the sealing.

In reference on FIGS. 15 and 16, one represented cylinder head 5, having surfaces of contact 47 with the ring 35 and his shim 43, which are well ground to ensure a good sealing, as well as centering 48 with part 39 of cylinder 2. The cylinder head presents radial fingers 49 bearing openings 6 of passage of the latch-tightening screws, with supports 50 of these screws. This form with fingers 49 ensures a better cooling of cylinder head 5 as well as a reduction of the aforementioned.

Cylinder head 5 is manufactured in a steel with high mechanical characteristics hot, so that it does not become deformed.

Figure 3:
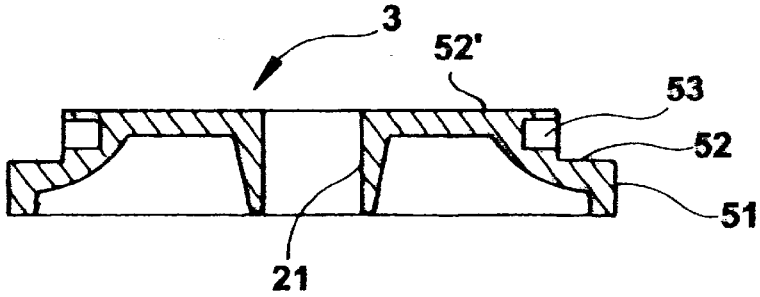
FIGS. 3 and 4 are, on a large scale, a sight in section and a sight in plan, respectively, of a stage of attachment equipping the engine with FIG. 1.
Figure 4:
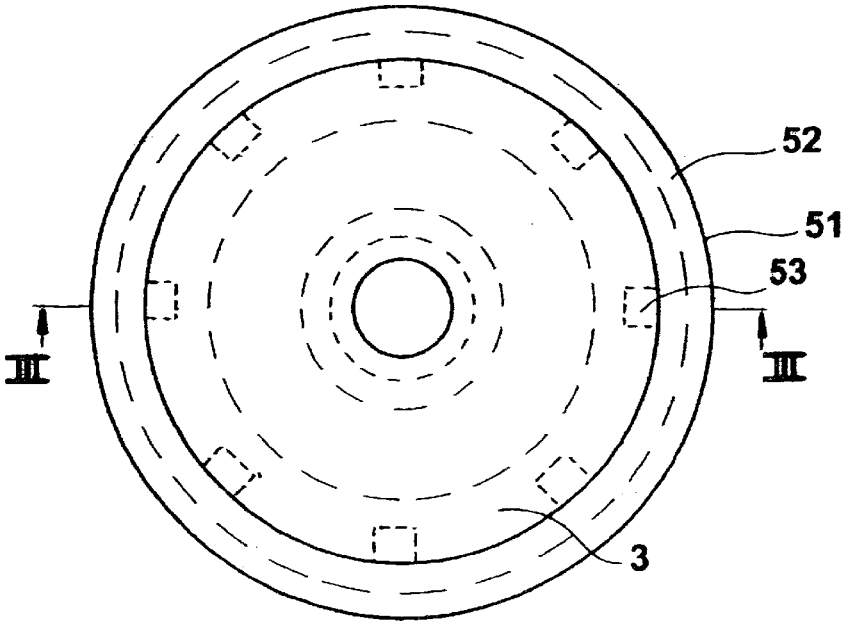

On FIGS. 3 and 4 one represented a stage 3 for the connecting rod assembly 18, whose external diameter 51 (as one sees it on the FIG. 1) ensures the positioning of half-casings 1 in a plan. Stage 3 presents a face of support 52' for the sleeve 16, which blocks the stage on casing 1. Radial peripheral residences 53 are intended to receive springs 54 (see FIG. 1) operating valves 55 of the eduction valve boxes 4, which slip on face 52, whereas central housing 21 of two stages 3 in glance guides a connecting rod assembly 18.

On FIGS. 5 and 6 one represented an eduction valve box 4 which is centered by its interior diameter 56 on stage 3. The eduction valve box 4 presents, regularly spaced on its periphery, eight openings inlet 57 which, with diameter 56, are used as seats with valves 55 (FIG. 1) which are positioned by springs 54 in support in housing 53 of stages 3, and by their longitudinal slip on face 52 of stage 3.

The inlet openings 57 are conical to facilitate the passage of the air and, between these lights 57, pass orifice 8 of the assy screw 8'.

In reference on FIGS. 7 and 8, one sees sleeve 16 of the cylinder 2, whose columns 59 of the lights of transfer 58 have the shape of static paddles which print a rotational movement to the air which engages there at high speed, this air turning like a cyclone around small diameter 34 of piston 17. The interior volume of cylinder 2 is reduced with the rise of piston 17, to form the combustion chamber 60 when the piston is at its point died high.

It is noticed that face 61 of sleeve 16 is resting against cylinder 2, whereas its face 62 is resting against stage 3.

Sleeve 16 is assembled with tightening over its length in order to block stage 3 in correspondence with the lights of the eduction valve box.

Sleeve 16 received a surface treatment very hard and self-lubricating.

On FIGS. 9 and 10, one represented the opened rigid connecting rod assembly 18, equipped with his two axes in alignment 22 which guide it in stages 3. The faces of support 63 of connecting rod assembly 18 are intended to rub on crank pin 19 of crankshaft 9, whereas the faces of side guidance 64, parts 65 of fixing of the pistons, centerings 66 and supports 67 cooperate with the perfect centering of pistons 17 and the stems 22 of connecting rod assembly 18.

Figure 11:
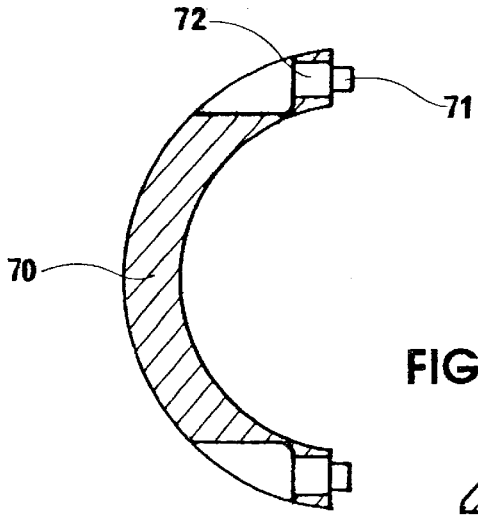
FIG. 11 is a sight in section of the hat intended to close the rigid connecting rod assembly of FIGS. 9 and 10.

Connecting rod assembly 18 is represented opened, to allow the introduction or the shrinking of the crank pin of the crankshaft. On each side of the open part of the connecting rod assembly, grooves 68 cooperate with fixings 69 to close the connecting rod assembly by means of hat 70 with semicircular section represented on the FIG. 11 and which gives to the connecting rod assembly the rigidity of a cast solid attachment. As one sees it with this FIG. 11, hat 70 present of the grooves 71, which are assembled without play in grooves 68 of connecting rod assembly 18 and residences 72 being used for the passage of fastening screws not represented.

In alternative, as one sees it on FIGS. 17 and 18, one represented another form of connection between a connecting rod assembly 18 and one crank pin 19. To this end a ring 73 is interposed between the crank pin of the crankshaft and the connecting rod assembly, in order to remove direct friction between these the last two elements.

This steel ring is covered with a hard and self-lubricating surface. After manufacture, ring 73 is cut out by electroerosion with the wire, to allow its assembly on the crank pin, then the slit left by the wire is filled with the assembly by an adhesive of structure which makes the ring cast solid and that cannot be taked to pieces.

As one sees it in particular on FIG. 18, the two cuttings separating parts 74 and 75 of ring 73 form a key which locks two half-rings 74, 75 after joining between them.

Ring 73 is around crank pins 19 and rolls on the tracks of connecting rod assemblies 18 as the wheel of a train on its rail.

Another form of connection, already known by itself, would consist in using shoes.

The balance of the engine describes above is regulated by the crank pins 19 of crankshaft 9 which are fixed to 90°0 one compared to the other, so that an explosion occurs with each rotation of 90° of the crankshaft. These explosions occur by auto-ignition when piston 17 is at the point died high, with a pressure of approximately 30 bars. However lighting can also be controlled with a lower pressure, for example for an operation with gases.

The injection in room 60 is carried out into 42 and the explosion propels the unit made up of a connecting rod assembly 18 and two pistons 17, by ensuring the drive of crankshaft 9 by crank pin 19. The inertia of connecting rod assembly 18 is cancelled by withdrawing compressive forces of precompression, aspiration and, to transmit a force higher of 30% approximately than that transmitted by a conventional connecting rod assembly articulated under the same conditions.

In the engine describes above and represented on FIG. 1, one sees that there are only three moving parts moving, which are the two connecting rod assemblies 18 and crankshaft 9, as well as the valves 55 which are thirty two.

One will notice the presence in the engine, according to the invention, of a great number of identical component. As follows:

four stages of connecting rod assembly 3, four eduction valve boxes 4, four sleeves 16, four cylinders 2, four rings of exhaust 35, four rings of admission 26, four cylinder heads 5, four pistons 17, two rigid attachments 18, thirty two valves 55, thirty two springs of valves 54, six half bearings of stages 11.

The same elements are used for construction of engines having 2,4,6,8 or 10 cylinders, only different half-casings 1, crankshafts 9, the intake manifolds (not represented) placed on the eduction valve boxes 4, the injection cam, the wheel and the dummy crank-case.

It will be understood that the description above was given to simple title of example, without restrictive character, and that constructive additions or amendments could be made there without coming out of the framework of the invention.

It will be understood in particular that, without leaving the framework of the invention, one could produce a radial engine, with four cylinders laid out around a casing of square section, with a cylinder all the 90° and one crankshaft with only one crank pin on which two rigid connecting rod assemblies placed are assembled side to coast and 90° one compared to the other.

The stacking of the parts would be then the same one as on an engine flat according to the invention and operation would be identical. To increase the rigidity of the tubular casing, the aforementioned would then be closed with each end by flasks whose edges would cover each end of the casing. The casing thus would consist of three parts, which are a cast solid tubular casing and two flasks forming lids which are used as stages for the crankshaft.

What I claim is:

1. Spark-ignition engine which comprises:

(a) at least two cylinders laid out flat and opposed one to the other;

(b) output shaft, (c) a cast solid crankshaft to transmit to said output shaft energy provided by explosions in said cylinders, said crankshaft having a crankpin, (d) a rigid connecting rod assembly connecting said crankshaft to pistons mobile in said cylinders, said connecting rod assembly being directly assembled on said crankshaft, (e) a plane surface of said connecting rod assembly being in direct contact with a cylindrical surface of said crankpin of said crankshaft, said crankpin presenting at least one jet fed with lubricant through an internal duct to sprinkle said lubricant on the plane surface of the connecting rod assembly which is in contact with the crankpin, ensuring a slip of said cylindrical surface on said plane surface carried out without friction.

2. Spark-ignition engine according to claim 1 which comprises two identical half-casings, said half-casings having a mating plane passing by an axis of said cylinders, of said rigid connecting rod assemblies, of bearings guiding said rigid connecting rod assemblies, of said pistons and of heads of said engine cylinders.

3. Spark-ignition engine according to claim 2 wherein said half-casings are positioned one compared to the other by engine components, this positioning being ensured in a plane by sealing rings and by bearings guiding said crankshaft, and in a perpendicular plane by said bearings guiding the rigid connecting rod assemblies.

4. Spark-ignition engine according to claim 3 wherein precompressed air, between each piston and the corresponding stage of the connecting rod assembly, enters in the casing by a play provided between said stage of the connecting rod assembly and a stem of the connecting rod assembly, by putting said casing under air pressure and by driving out oil being in said casing through a drain equipped with a non-return valve.

5. Spark-ignition engine according to claim 1 wherein each cylinder has a bottom part ending in a truncated cone, a top portion of said truncated cone defining with an end potion of said piston an exhaust port, said exhaust port closing before lights transferring air from outside into said cylinder, so that at closing of said exhaust port gases which move with very high speed in the cylinder are crushed and strongly densify in said top portion of said truncated cone by producing a strong depression on the level of said lights still open, said depression causing a second air admission within a same cycle of the engine, thus producing an important overfeeding which lasts until said lights are closed.

6. Spark-ignition engine according to claim 5 wherein said piston comprises a large diameter portion and a small diameter portion, said large diameter portion of the piston presenting a cone identical to said truncated cone of the cylinder, said piston cone being prolonged towards said small diameter portion of the piston by a machining which defines together with said cylinder, when said piston arrived to a top dead center, an annular combustion chamber.

7. Spark-ignition engine according to claim 6 wherein an exhaust ring is assembled with tightening to a cone of the small diameter portion of the piston for ensuring of tight closing of the exhaust port.

8. Spark-ignition engine according to claim 7 wherein inlet openings for outside air are located around and nearest possible to said lights for transferring air into the cylinder, a cone virtually identical to the cone of the piston directly leading and guiding, without pressure loss, air from said inlet openings towards said lights which close, after said exhaust port, with a ring placed on said large diameter of said piston.

9. Spark-ignition engine according to claim 5 wherein columns of the lights have the shape of static paddles imparting a rotational movement to air admitted at a high speed, generating a cyclone within each combustion chamber.

10. Spark-ignition engine according to claim 8 wherein said large diameter portion of each piston comprises two parts between which is blocked a shim of said ring, this ring being floating to ensure, by an external diameter, a sealing with an internal diameter of a sleeve portion of the cylinder.

11. Spark-ignition engine according to claim 10 wherein components of the engine including stages of the connecting rod assembly, eduction valve boxes, the cylinders, said sleeve portions of the cylinders, the shims of the said rings and the cylinder heads are centered the ones with the others and on the casing according to a same axis which is also an axis of translation of the connecting rod assemblies and of the pistons.

12. Spark-ignition engine according to claim 11 wherein components of the engine including said stages of the connecting rod assembly, said eduction valve boxes, said cylinders, said cylinder sleeves and said ring shims are blocked together while being tight between the cylinder head and the casing.

13. Spark-ignition engine according to claim 12 wherein the cylinder heads are out of high-strength steel and said components of the engine are made of aluminum, said cylinder heads blocking said aluminum components on said cases, preventing those components from becoming deformed hot.

14. Spark-ignition engine according to claim 1 wherein said crankshaft comprises at least one lubrication conduit of large diameter, ensuring lubrication of stages and crankpins of the crankshaft.

15. Spark-ignition engine according to claim 14 wherein each crankpin of said crankshaft is equipped with jets of small diameter, said jets sending oil under pressure on plane faces of said connecting rod assemblies, so that displacement of said crankpins directly in lights of the connecting rod assemblies is carried out according to a slip without friction by oil corner on very hard and self-lubricating surfaces.

16. Spark-ignition engine according to claim 15 wherein oil pressure for lubrication of the engine is regulated by a throttling disposed on each exit of the lubrication and coolant circuits of the exhaust rings.

* * * * *